United States Patent [19]

Guslits et al.

[11] Patent Number: 5,025,289

[45] Date of Patent: Jun. 18, 1991

[54] DEVELOPMENT APPARATUS HAVING SELF-CLOSING PURGING MECHANISM

[75] Inventors: Vladimir S. Guslits, Rochester; John P. Swapceinski, Bergen, both of N.Y.

[73] Assignee: Eastman Kodak Company, Rochester, N.Y.

[21] Appl. No.: 434,198

[22] Filed: Nov. 13, 1989

[51] Int. Cl.[5] ..... G03G 15/09

[52] U.S. Cl. ..... 355/253; 118/657; 355/251; 355/260

[58] Field of Search ..... 118/657, 658, 661; 355/251, 253, 260, 298; 222/DIG. 1; 354/324, 331, 333, 335, 336

[56] References Cited

U.S. PATENT DOCUMENTS

| | | | |
|---|---|---|---|
| 3,885,709 | 5/1975 | Levy | 222/DIG. 1 |
| 3,955,533 | 5/1976 | Smith et al. | 355/297 X |
| 4,439,034 | 3/1984 | Daniels | 118/658 |
| 4,451,135 | 5/1984 | Kopp et al. | 355/253 |
| 4,461,238 | 7/1984 | Baier et al. | 355/253 X |
| 4,522,487 | 6/1985 | Misawa . | |
| 4,601,569 | 7/1986 | Garris . | |
| 4,610,534 | 9/1986 | Ito et al. . | |
| 4,634,286 | 1/1987 | Pike | 118/657 X |
| 4,656,966 | 4/1987 | Guistina | 118/661 |
| 4,692,017 | 9/1987 | Maczusenko et al. | 118/586 X |
| 4,821,075 | 4/1989 | Saito et al. | 118/657 X |
| 4,845,523 | 7/1989 | Miyaji | 355/260 X |
| 4,878,089 | 10/1989 | Guslits et al. | 118/657 X |

FOREIGN PATENT DOCUMENTS

| | | | |
|---|---|---|---|
| 0-164977 | 6/1989 | Japan | 355/260 |

*Primary Examiner*—A. T. Grimley
*Assistant Examiner*—Matthew S. Smith
*Attorney, Agent, or Firm*—Tallam I. Nguti

[57] ABSTRACT

A development apparatus for use in electrostatographic copiers and printers includes a housing and a self-closing mechanism for completely and efficiently unloading or purging spent developer material from such apparatus. The mechanism further includes an aperture for discharging developer material from the housing, a self-closing conduit member connected to the aperture, and vacuum source for selectively transporting and removing developer material from the conduit member.

7 Claims, 1 Drawing Sheet

DEVELOPMENT APPARATUS HAVING SELF-CLOSING PURGING MECHANISM

BACKGROUND OF THE INVENTION

This invention relates to development apparatus in electrostatographic copiers and printers, and more particularly to a development apparatus that includes a mechanism for completely and efficiently unloading or purging spent developer material from such apparatus.

In electrostatographic copiers and printers that produce or reproduce copies of images, it is well known to use triboelectrically charged developer material held in a development apparatus, to develop latent images formed electrostatographically on an image-bearing member. The development material may consist, for example, of a mix of carrier particles and toner particles which possess properties allowing them to be triboelectrically charged to opposite polarities respectively by being stirred and mixed together within the development apparatus. When developer material, charged as such, is used to develop electrostatically formed images as above, the charged toner particles are attracted to, and held by the images being developed, while the carrier particles are left in the development apparatus.

The quality of images so developed depends significantly on the charge value, as well as, on the concentration of toner particles in the developer material mix. Image development, of course, gradually depletes the level or concentration of toner particles in the developer material mix within the development of images, the concentration of toner particles in the mix is monitored, and is controlled by periodically replenishing or adding fresh toner particles to the spent mix within the development apparatus. Additionally, image development also gradually depletes the quantity of carrier particles within the development apparatus through some of the carrier particles being undesirably picked up by the image-bearing member during development.

More significantly too, the rest of the carrier particles left in the development apparatus usually will reach a point where they start to lose their triboelectric properties, thereby detrimentally affecting the charge values of subsequent developer mixes obtained merely by adding fresh toner particles to such carrier particles. Therefore, in order to maintain quality development of images over time, the entire developer mix contents of the development apparatus must at such point be completely unloaded or purged, and the apparatus refilled with fresh carrier and toner particles.

Conventional apparatus and mechanisms for doing so, as disclosed for example in U.S. Pat. No. 4,451,133 issued May 29, 1984, to Kopp et al, typically have included many movable parts such as pivotable plates, flexible tubes and releasable clamps, in addition to damagable parts such as the tubes. Such conventional devices also require separate means for closing or sealing their access opening into the development apparatus. As such, they involve the risk of inadvertent spills from misclosures, as well as, significant downtimes for opening and closing such means.

SUMMARY OF THE INVENTION

It is an object of the present invention to provide a development apparatus that includes a mechanism, which has relatively few moving parts, for purging developer material from such apparatus.

In accordance with the present invention, a development apparatus in an electrostatographic copier or printer includes a housing that has a bottom portion for holding developer material, and a mechanism, associated with such bottom portion of the housing, for purging developer material from the housing. The purging mechanism includes an aperture in the bottom portion of the housing for discharging developer material from the housing, and means within the bottom portion for moving developer material across such aperture. The purging mechanism further includes a conduit member, having automatic self-closing means, connected to such aperture for guiding the flow of developer material, discharging from the housing through the aperture in response to transport means transporting such developer material, through the conduit member.

The mechanism for unloading or purging developer material from the development apparatus of the present invention is simple, efficient and compact. It includes few moving components. It is automatically self-closing. It therefore prevents significant downtime, and involves little or no risk of moving component failure, or of inadvertent spills.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
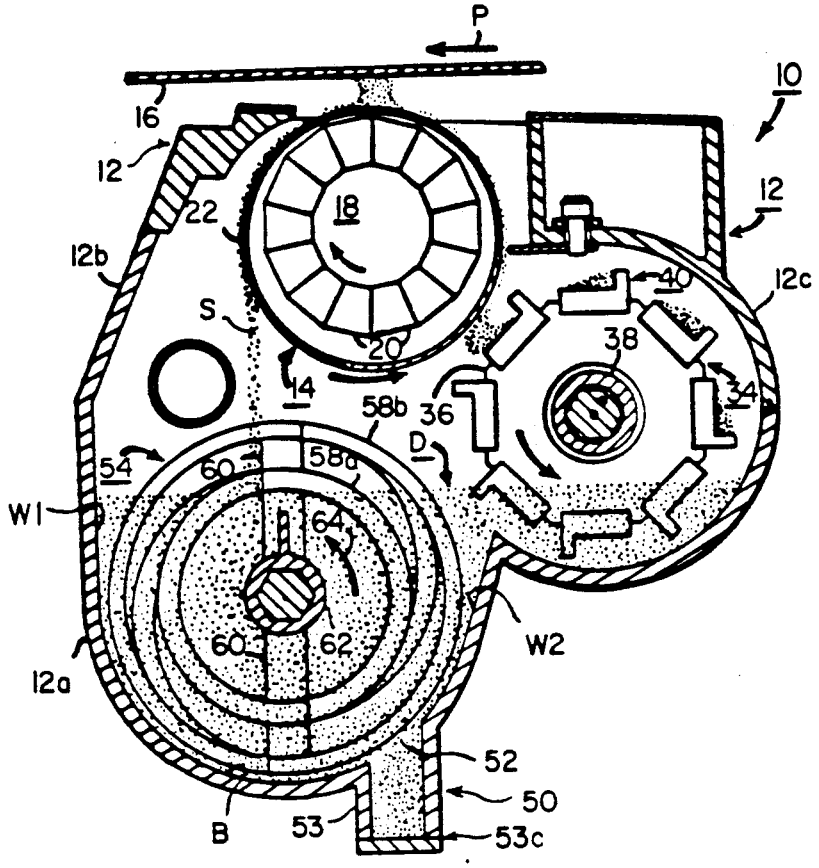
FIG. 1 is an end sectional view of the development apparatus of the present invention.

Referring now to the accompanying drawings, FIG. 1 shows, in an end section, a development apparatus designated generally by the numeral 10. The development apparatus 10 includes a housing 12 having intercommunicating portions 12*a*, 12*b*, and 12*c*, of which a bottom portion 12*a* serves as a sump portion or reservoir for holding development material D.

The housing 12 can, for example, be die-casted of an aluminum alloy. The developer material D is, for example, a two-component material consisting of magnetic carrier particles intermixed with pigmented toner particles. A single component developer material consisting simply of toner particles is also suitable for use with the development apparatus 10. The top portion 12*b* of the housing 12 contains a magnetic development roller 14 for applying the toner particles of the developer material to image patterns formed electrostatically on a dielectric member 16 moving along a path P in juxtaposition to an opening in the top housing portion 12*b*.

The magnetic development roller 14 includes a core 18 having a plurality of magnets 20 spaced around the peripheral surface of the core. The roller 14 also includes a non-magnetic, substantially cylindrical shell 22 which surrounds the core 18, and which has its longitudinal axis offset from the longitudinal axis of the core 18. Such offset or eccentricity of the shell has the effect of decreasing the field strength of the magnets 20 over the area of the shell 22 that is spaced farther from the magnets. As such, after development, spent developer material moving on the surface of the shell 22 has less propensity to magnetically adhere to the shell when it reaches that particular area, and therefore falls off the shell and returns to the reservoir or bottom portion 12*a*.

As is well known, the core 18 and/or shell 22 can be fixed or rotatable as long as the particular arrangement causes the developer material D to move within the fields of the magnets 20 into developer-applying contact with the dielectric member 16. In the development roller 14, as illustrated in FIG. 1, the core 18, with its magnets 20, rotates clockwise, while the shell 22 rotates counterclockwise. A feed device 34 which is located within the housing portion 12*c* between the top and bottom portions 12*b*, 12*a*, respectively, serves to transport the developer material D into the field of the magnets 20 of the development roller 14. The device 34 includes a roller 36 which is mounted rotatably on a shaft 38, and includes a plurality of pickup members 40.

Pickup members 40, as shown, are moved through the developer material D for picking up and carrying quantities of developer material to a drop point within the magnetic fields of the magnets 20. There the developer material is dropped off each member 40, and is readily attracted by the magnets 20 to the outside surface of the shell 22 of development roller 14. The roller 14 then moves the developer material, so attracted, into applying relation with the image patterns on the dielectric member 16, where the imagewise patterns attract and adhere to toner particles from the developer material mix D.

Although some carrier particles are also attracted to the image patterns during such development, the carrier particles or spent developer, by design should be, and are indeed left behind in the development apparatus 10. After such development, such spent developer material, consisting largely of carrier particles on the shell 22, is moved thereon until it reaches that area of the shell surface where the magnetic influence of the magnets 20 is weak. There, the spent developer gravitationally falls back into the bottom portion 12*a*.

Fresh toner particles periodically are added to the sump portion 12*a* for mixing in order to achieve and maintain desired toner concentration and triboelectric charge values. At some point however, the quantity of carrier particles being returned to the sump portion 12*a*, as well as, their triboelectric properties, will become so diluted, such carrier particles should desirably be purged from the housing 12, and replaced with fresh carrier and fresh toner particles.

Figure 2:
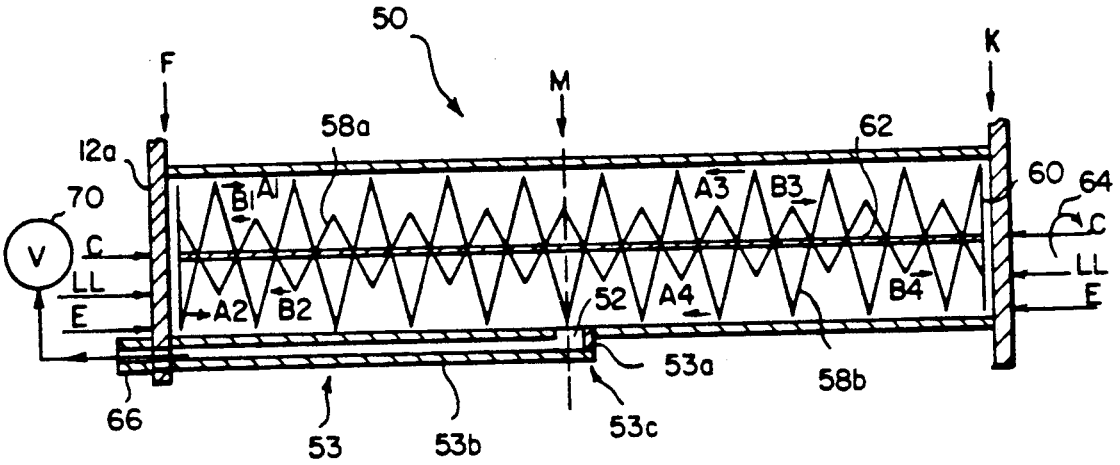
FIG. 2 is a side sectional view of the bottom portion of the development apparatus of FIG. 1 showing the purging mechanism of the present invention.

Referring to FIGS. 1 and 2, the development apparatus 10 accordingly includes a self-closing mechanism 50, associated with the bottom portion 12*a* of the housing 12, that is suitable for unloading or purging the spent developer material D from the housing 12. Such unloading or purging, as stated above, is carried out in order to refill the housing 12 with fresh carrier and fresh toner particles of developer material D. Doing so provides a desired quantity of carrier particles to the housing 12, and particularly carrier particles with strong triboelectric properties, in order to desirably improve and maintain developer material charge values, as well as, toner concentrations.

As illustrated, the purging mechanism 50 includes an aperture 52 in the bottom portion 12*a* of the housing 12. The aperture 52 opens into a connected conduit member 53. The aperture 52 is located such that developer material D within the bottom portion 12*a* can discharge or drop therethrough into the conduit 53. As shown in FIG. 1, the bottom portion 12*a* includes a base area B and two upwardly extending side walls, W1 and W2. In order to maintain developer within the aperture 52 in a free-to-flow condition, the aperture 52 is formed preferably in one of these side walls, for example W2, and at a location thereon that is spaced above the base B. Due to such a preferred location, developer material D elsewhere within the housing 12, including the base B, must be moved to the aperture 52. As additionally shown in FIG. 2, the aperture 52 is also located at a position M that is halfway between the front end wall F, and back end wall K, of bottom portion 12*a* of the housing 12. Developer material D therefore must also be moved from the front F and back K to the midpoint M, where the aperture is located.

The purging mechanism 50 accordingly includes developer moving means, such as a ribbon blender/-transport device 54 that is located within the bottom portion 12*a* for moving developer material D across the aperture 52, by moving such material D around and around within the bottom portion 12*a*, as well as, from the front and back ends F and K, respectively, to the middle M. As additionally shown, spent developer material falling back from the development roller 14 into the bottom portion 12*a* is immediately mixed in and moved as such by the moving means 54.

The device 54, for example, may include a small diameter, inner helical ribbon 58*a* and a large diameter, outer ribbon 58*b* that are connected to a rotatable drive shaft 62 by means of radial members 60. The ribbons 58*a*, 58*b* are arranged in two major front and back sections FM and KM, respectively. The front and back sections, FM and KM are pitched such that rotation of the shaft 62, in the direction of the arrow 64, will cause the respective sections to move developer material D circumferentially within the bottom portion 12*a*, as well as linearly in the directions of the arrows $A_1$, $A_2$ and $A_3$, $A_4$ for the larger diameter ribbons 58*b*, and in the directions of the arrows $B_1$, $B_2$ and $B_3$, $B_4$ for the inner, small diameter ribbons 58*a*.

As indicated, the inner ribbons 58*a* are effective in moving developer material D outwardly from the center M to the front and back end walls F and K, respectively, but only that much of the developer material which, after filling the bottom portion 12*a*, lies above the level shown as LL. On the other hand, the larger diameter, outer ribbons 58*b* are effective in moving all developer material within the bottom portion 12*a* from the front and back ends F and K, respectively as indicated, to the middle M. Such movement of the developer material D by the ribbon/transport device 54 desirably, and by design, also serves to stir and mix the carrier and toner particles that constitute such developer. As pointed out above, such stirring and mixing, triboelectrically charges the particles appropriately for effective image development by the apparatus 10.

The purging mechanism 50, as shown, further includes the developer material conduit member 53 which is connected to the outside of the housing 12, and over the discharge aperture 52. Conduit member 53 thus serves to hold as well as guide the flow of developer material discharging or dropping from the housing 12, through the aperture 52, into such conduit.

As shown, the conduit 53 has a short downward section 53*a* over the aperture 52. The section 53*a* is connected to a long substantially horizontal section 53*b* that runs from the aperture 52 to the front F of the bottom portion 12*a*. The sections 53*a* and 53*b* form a sharp conduit elbow 53*c*. The conduit 53 may be formed integrally with the housing 12 so that it forms a closedsided channel over the aperture 52, on the outside of housing. The short section 53*a*, the long section 53*b* and the sharp elbow 53*c* constitute an effective means for automatically closing or self-closing the mechanism 50 when the housing 12 of the apparatus 10 is filled or loaded with developer material D. Because of the self-closing feature, the section 53*b* is simply left open at such front end F, where a quick connect and disconnect adapter 66 may be mounted over such opening.

The conduit 53 is therefore completely open to the front F as well as into the discharge aperture 52, when there is no developer material D inside the bottom portion 12*a*. However, when the bottom portion 12*a* is loaded or filled with developer material which is being moved by the device 54, as described above, a small quantity of the developer material D will gravitationally drop through the aperture 52, down the short conduit section 53*a* and into the sharp elbow 53*c*. Such a small quantity of developer material D within the elbow 53*c* will on its own not flow horizontally through the section 53*b*. Instead, it will sit there trapped, and will cause first the elbow 53*c*, and then the aperture 52, to fill up with developer, thereby effectively blocking and causing the conduit 53 to automatically self-close.

Once the conduit 53 is closed as such, developer material D within the bottom portion 12*a* can be stirred, mixed and moved within the apparatus 10, without spilling or leaking, for image development in the manner described above. Such stirring and mixing will continue until it is desired to unload or purge all developer material from the apparatus 10. To effect such purging or unloading, the developer material trapped in the elbow 53*c* is caused to flow horizontally through and out of the section 53*b*.

For opening the previously closed conduit 53 and causing developer material to flow through the section 53*b*, force means for pulling the trapped developer material out of the elbow 53*c* should be applied through the horizontal section 53*b*. Such force means can be supplied for example by a vacuum source 70 connected to the purging mechanism 50 by means of the adapter 66. When connected and activated, vacuum source 70 will exert a pulling force on the developer material in the elbow 53*c*, thereby pulling it out through the section 53*b*, and thereby allowing more developer to discharge into the elbow for similar removal. Vacuum source 70 should therefore just be strong enough to induce horizontal flow in, and to transport developer material through the horizontal section 53*b* of conduit member 53. The vacuum source 70 as such can be attached to a corresponding connector for use with the adapter 66 without significant downtime, as well as, to a receiving container for receiving the developer material purged from the apparatus 10.

Operationally, the housing 12 is normally filled with developer material D to a level well above that shown as LL. Filling the housing 12 as such causes the conduit 53 to self-close. Thereafter, the ribbon/transport device 54 functions purely as a stirrer/mixer, triboelectrically charging and moving the developer therein for appropriate development of images. The developer material so mixed is moved upwards by feed device 34, as described above, to the development roller 14 for such image development. Spent developer from such development drops back as indicated into the bottom portion 12*a* for continued mixing by the device 54.

When for the reasons cited above it is finally desirable to purge the apparatus 10 of developer material therein, the vacuum source 70, with a receiving container attached thereto, is connected to the adapter 66, and activated. The activated vacuum source 70 induces flow in, thereby sucking, developer material through the horizontal conduit section 53*b* and out of the elbow 53*c*. The sucked out developer can then be collected in the receiving container for clean disposal. Within the housing 12, the ribbon/transport device 54, the feed roller 36 and development roller 14 are all rotated to move the developer material therein in the respective manners as described above. As the vacuum source 70 sucks up developer material, it empties the horizontal section 53*b*, as well as the elbow 53*c*, and aperture 52. As this occurs, additional developer material being moved within the housing 12, and by the device 54 to the aperture 52, will drop or discharge through the aperture 52 into the elbow 53*c* to be similarly sucked up by the source 70.

Before long, the level of developer material within the housing 12 will drop below the reach of the pickup members 40 of the feed roller 36. Consequently, the flow of developer material from the roller 36 to the development roller 14 will be cut off. Thereafter, any quantity of developer material on the roller 14 will move with the roller as indicated and completely fall back into the bottom portion 12*a* for movement therein by the device 54.

Within the bottom portion 12*a*, both the inner and outer ribbons 58*a*, 58*b* of the device 54 will continue to move developer material as long as the level of developer material therein is higher than the level indicated as LL. Such back and forth, and around and around, movements serve to keep the material loose and free flowing through the aperture 52. When the level of material finally falls below the LL level, only the outer ribbons 58*b* will continue to move such material circumferentially and inwardly to the aperture 52 until the entire housing 12, including the base B of the bottom portion 12*a*, is completely empty (point E) of developer material.

The vacuum source 70 can be de-activated and disconnected at that point, and the housing 12 refilled or reloaded with fresh developer material. As described, refilling or reloading the housing 12 as such will cause the conduit 53 to again self-close, thereby allowing the developer material in the housing 12 to be stirred, mixed and moved for development purposes, without risk of spilling or leakage.

As can be seen, the development apparatus 10 of the present invention includes a simple, efficient and compact mechanism 50 for unloading or purging developer material therefrom. The purging mechanism 50 includes few moving components, and is automatically self-closing, thereby avoiding significant downtime, the risks of moving component failure, and the risk of inadvertent spills.

The invention has been described in detail with particular reference to a preferred embodiment thereof, but it will be understood that variations and modifications can be effected within the spirit and scope of the invention.

We claim:

1. A development apparatus in an electrostatographic copier or printer, the apparatus including:

(a) a housing having a bottom portion for holding developer material; and (b) a mechanism, associated with said bottom portion of said housing for purging developer material from said housing, said purging mechanism including:

(i) an aperture in said bottom portion of said housing, for discharging developer material from said housing;

(ii) means, within said bottom portion of said housing, for moving developer material across said aperture; and (iii) a developer material holding and transport conduit connected to the outside of said housing over said aperture, said conduit forming automatic self-closing means for blocking the flow of developer material out of said housing through said aperture, said automatic self-closing means including a developer material trapping elbow just below said aperture for trapping a small amount of developer material thereby causing developer material to block and close said aperture, said trapping elbow being formed by a short downward conduit section, and a long substantially horizontal conduit section, said horizontal conduit section having an open end from the outside into said elbow requiring no closing means thereto; and (iv) transport means associated with said open end of said horizontal conduit section for selectively causing said developer material trapped in said elbow, and developer material discharging into said elbow, to flow through said horizontal conduit section and out of said open end thereof.

2. The purging mechanism of claim 1, wherein said discharge aperture is formed in an upwardly extending wall of said bottom portion of said housing.

3. The purging mechanism of claim 1, wherein said developer material moving means consists of a ribbon blender including a rotatable shaft having ribbons mounted thereto, said ribbon blender having a small diameter inner helical ribbon for moving some of the developer material within the bottom portion away from said discharge aperture, and a large diameter outer helical ribbon for moving all the developer material within said bottom portion to said discharge aperture.

4. The purging mechanism of claim 1, wherein said conduit member consists of an open-ended, close-sided channel along the outside of said housing.

5. The purging mechanism of claim 1, wherein said transport means for selectively transporting developer material through said conduit member consists of a vacuum force, applied through said conduit member by a vacuum source connected thereto, for pulling developer material through and out of said conduit member.

6. The purging mechanism of claim 1, wherein said discharge aperture is formed at a location halfway between the front end and the back end of said housing.

7. A purging mechanism in a development apparatus for selectively purging spent developer from the development apparatus, the purging mechanism including:

(a) an aperture formed in an upwardly extending wall of the housing of said development apparatus for receiving and maintaining developer material discharging from said housing in a free-to-flow state;

(b) a developer material holding and transport conduit connected to the outside of said housing over said aperture, said conduit having a short downward section and a long substantially horizontal section, said long horizontal section being connected at one end to said downward section forming a sharp elbow for trapping developer material discharging from said housing thereby automatically blocking and closing said elbow, said downward section and said aperture, and said long horizontal conduit section being open at the other end and therefore requiring no closing means thereto; and (c) transport means associated with said open other end of said long horizontal section for selectively causing developer material in said elbow, in said downward section and discharging through said aperture, to flow through said long horizontal section and out of said open other end.

* * * * *